US005921000A

United States Patent [19]

Wedel et al.

[11] Patent Number: 5,921,000

[45] Date of Patent: Jul. 13, 1999

[54] ALTERNATING TOP AND BOTTOM FELTED DRYERS CONNECTED WITHOUT OPEN DRAW

[75] Inventors: Gregory L. Wedel, Beloit, Wis.; Jeffrey H. Pulkowski, Roscoe, Ill.

[73] Assignee: Beloit Technologies, Inc., Wilmington, Del.

[21] Appl. No.: 08/787,344

[22] Filed: Jan. 27, 1997

[51] Int. Cl.[6] ..... F26B 11/02

[52] U.S. Cl. ..... 34/117; 34/114; 34/116

[58] Field of Search ..... 34/114, 115, 116, 34/117, 120, 122, 123

[56] References Cited

U.S. PATENT DOCUMENTS

| | | | |
|---|---|---|---|
| 1,615,210 | 1/1927 | Asten | 34/68 |
| 3,134,653 | 5/1964 | Justus et al. | 34/114 |
| 4,183,148 | 1/1980 | Koski et al. | 34/454 |
| 5,033,207 | 7/1991 | Sturm et al. | 34/115 |
| 5,046,266 | 9/1991 | Autio | 34/120 |
| 5,065,529 | 11/1991 | Skaugen et al. | 34/117 |
| 5,269,074 | 12/1993 | Sims et al. | 34/117 |
| 5,279,049 | 1/1994 | Skaugen et al. | 34/115 |
| 5,388,347 | 2/1995 | Kerttula et al. | 34/457 |
| 5,416,980 | 5/1995 | Ilvespää | 34/117 |
| 5,426,867 | 6/1995 | Yli-Kauppila et al. | 34/452 |
| 5,495,678 | 3/1996 | Ilmarinen et al. | 34/117 |
| 5,539,999 | 7/1996 | Kuhasalo | 34/455 |
| 5,653,041 | 8/1997 | Ilmarinen et al. | 34/117 |
| 5,720,109 | 2/1998 | Yli-Kauppila | 34/117 |
| 5,737,848 | 4/1998 | Chau-Huu et al. | 34/114 |

FOREIGN PATENT DOCUMENTS

| | | |
|---|---|---|
| 0 445 487 A1 | 9/1991 | European Pat. Off. . |
| 0 620 313 A2 | 3/1994 | European Pat. Off. . |
| 0 620 314 A2 | 3/1994 | European Pat. Off. . |
| 0 653 514 | 5/1995 | European Pat. Off. . |
| 391 652 | 3/1924 | Germany . |

*Primary Examiner*—Henry Bennett
*Assistant Examiner*—Pamela A. Wilson
*Attorney, Agent, or Firm*—Lathrop & Clark LLP

[57] ABSTRACT

A dryer section employs top-felted and bottom-felted dryer sections each comprised of a single steam-heated drying cylinder with a diameter of about 12 feet. The web is transferred between drying cylinders by a two vacuum roll transfer without an open draw. The dryer fabric wrap on the large dryer cylinders is over 270 degrees resulting in large drying capability per dryer roll. Because each large dryer is followed by another large dryer roll which dries the opposite side of the web, uniformity of drying is maintained. Each dryer cylinder may have its own dryer fabric stretcher and guides. Alternatively, individual dryer fabrics service multiple top-felted dryers and bottom-felted dryers respectively. The web is constrained approximately 96 percent of the time as it passes through the is dryer section. The dryer section can achieve 2.9 inches of dryer surface in the machine direction for every inch of dryer section.

27 Claims, 5 Drawing Sheets

ALTERNATING TOP AND BOTTOM FELTED DRYERS CONNECTED WITHOUT OPEN DRAW

FIELD OF THE INVENTION

This invention relates to dryers used in papermaking in general and more particularly to dryer sections employing top-felted and bottom-felted dryers.

BACKGROUND OF THE INVENTION

Paper is manufactured as a continuously formed web on a papermaking machine. In the last 30 years the speed at which paper is manufactured has been substantially increased. The speed at which the paper web is formed has doubled from approximately 3,000 feet per minute to upwards of 6,000 feet per minute on today's state of the art machines. The manufacture of paper starts with wood fibers suspended in is water to form a very dilute solution composed of over 99 percent water. The fiber suspension is directed onto a forming wire or between two wire screens in the forming section of a papermaking machine.

After the paper web has been formed it is pressed to approximately 50 percent water content in the pressing section of the papermaking machine. The pressing section is followed by tiers of dryers which typically employ steam heating to dry the web until it contains only about 5 percent moisture. The dried web is then smoothed by passage through a calender. And the web is then wound into reels of paper at the dry end of the papermaking machine for further processing or sale.

The search for ways of improving the rate of the production of paper has also lead to increases in the width of the paper web being formed to approximately 400 inches. Increasing the width of the paper web being formed beyond 400 inches does not, at this time, appear to be practical because of the difficulty of controlling the shape of the rolls and the pressure between rolls used in the papermaking machine.

Thus, the future improvements in papermaking are seen in the reengineering of each component of the papermaking machine to increase the speed of the machines and improve the operating efficiencies. Further, efforts are needed to decrease the number of individual rolls employed in such a way as to shorten the overall length of the papermaking machine, with the goal of reducing the overall size of the machine. At the same time the length of the papermaking machine is being reduced the individual components—from the former through the winder—are being engineered to function better at high speeds: The entire papermaking machine is being engineered for better and automatic threading; the paper is being supported throughout its travel through the papermaking machine; and active feedback and monitoring of the paper web's properties are being employed. These improvements should set the stage for further increases in paper forming speeds. One section of the papermaking machine which has received considerable attention is the dryer section. A dryer section in a typical papermaking machine takes up substantially more than half of the overall length of the machine and considerably more than half of the energy used in forming the paper.

Some of the problems with conventional two-felted, two-tiered dryer sections where the wet web passes from one cylinder to the next in a generally serpentine fashion, are: the existence of long unsupported "open draws," problems with tail threading, sheet flutter in the open draws, cross-directional sheet shrinkage, and inefficient ventilation of evaporated water.

Some of the problems, including sheet flutter, sheet shrinkage and vapor ventilation, have been solved by replacing the two-felted, two-tiered dryer sections with single-tier BelRun™ dryer sections as manufactured by Beloit Corporation of Beloit, Wis. Extension of the single-tier concept to include more dryer cylinders in the single-tier configuration has provided significant improvements in the operation of the dryer section.

The use of both top-felted single-tier dryer sections followed by bottom-felted single-tier dryer sections has improved sheet one-sidedness. Such systems are exemplified by the Beloit Bel-Champ™ dryer section. One advantage of the single-tier dryer section is its ability to have the tail threaded through the dryer section without the use of threading ropes. A further advantage is the elimination of open draws where sheet flutter can result in wrinkled paper or even paper breaks. Still further advantages of the single tier dryers include better access for removing broke, improved ventilation, reduced web shrinkage, improved sheet surface and strength properties, and improved machine runability. Many of these advantages are achieved through the application of vacuum to the intermediate vacuum rollers. Open draws between dryer sections are eliminated through the use of transfers where the web is supported by two felts as it transfers between dryer sections.

Constraining the sheet while it moves through the dryer section increases sheet restraint in the cross-machine direction, which reduces shrinkage in the cross-machine direction. In a conventional dryer section, the web is constrained only approximately 58 percent of the time as it moves through the dryer section of the papermaking machine. By comparison, fabric pressure and vacuum rolls hold the paper web in the BelRun™ approximately 84.3 percent of the time it is in the drying section.

Although the BelRun™ and Bel-Champ™ dryer configurations offer significant improvements over other dryer section designs, one of the limitations of the BelRun™ and Bel-Champ™ single-tier dryer sections is that the cross-directional sheet restraint is not applied for 100 percent of the cycle time. A further limitation is the large number of vacuum rolls required to restrain the wet web from cylinder to cylinder in between sections.

What is needed is a dryer section with improved web constraint in the cross-machine direction and greater compactness in overall length of the dryer section.

SUMMARY OF THE INVENTION

The dryer section of this invention employs top-felted and bottom-felted dryer sections where each section is made up of a single steam-heated drying cylinder with a diameter of about 12 feet. The web is transferred between the large single cylinders making up the dryer sections using a two vacuum roll transfer without an open draw. The rolls are arranged so the felt wrap on the large dryer cylinders is over 270 degrees so the combination of dryer diameter and wrap angle results in large drying capability per dryer roll. Because each large dryer is followed by another large dryer roll which dries the opposite side of the web, uniformity of drying is maintained. Drying uniformity promotes sheet one-sidedness and prevents the development of curl. Each dryer cylinder may be provided with its own felt stretcher and guide. Alternatively, a single top felt can service several of the top-felted dryers and a single bottom felt can service several of the bottom-felted dryers. The total number of vacuum rolls required to transfer the web between the top-felted dryer roll and the bottom-felted dryer roll is not increased over the conventional Bel-Champ™ design even though two rolls are used to transfer the wet web between each pair of cylinders, because the amount of drying per cylinder has been greatly increased. The result is a dryer section where the web is constrained approximately 96 percent of the time as it passes through the dryer section. The dryer section designed according to this invention can achieve 2.9 inches of dryer surface in the machine direction for every inch of length added to the paper machine by the dryer section.

It is a feature of the present invention to provide a dryer section in a papermaking machine which reduces cross-machine direction shrinkage of the paper web.

It is a further feature of the present invention to provide a dryer section in a papermaking machine with greater drying length per unit length of the dryer section.

It is an additional feature of the present invention to provide a dryer section which is threadable without ropes, and which has improved access.

It is another feature of the present invention to provide a dryer section which achieves a given level of drying with reduced number of dryer rolls, doctors, bearings, and frames.

It is also a feature of the present invention to provide a dryer section which drys both sides of the web, and which has good ventilation.

It is a further feature of the present invention to provide a dryer section which may effectively be used with air impingement of auxiliary drying.

It is a still further feature of the present invention to provide a dryer section in a papermaking machine where the number of dryer felt drive rolls may be reduced.

It is yet another feature of the present invention to provide a drying section in a papermaking machine wherein each dryer cylinder can be provided with its own felt, stretcher and guide.

It is yet another feature of the present invention to provide a dryer section in a papermaking machine with improved start-up broke removal and operability.

It is yet another feature of the present invention to provide a dryer section in a papermaking machine wherein transfers between adjacent dryers in the process direction occur without open draw.

It is a yet further feature of the present invention to provide a dryer section for a papermaking machine wherein the paper web is constrained for a greater percentage of the time the web spends passing through the dryer section.

Further objects, features and advantages of the invention will be apparent from the following detailed description when taken in conjunction with the accompanying drawings.

DESCRIPTION OF THE PREFERRED EMBODIMENT

Figure 1A:
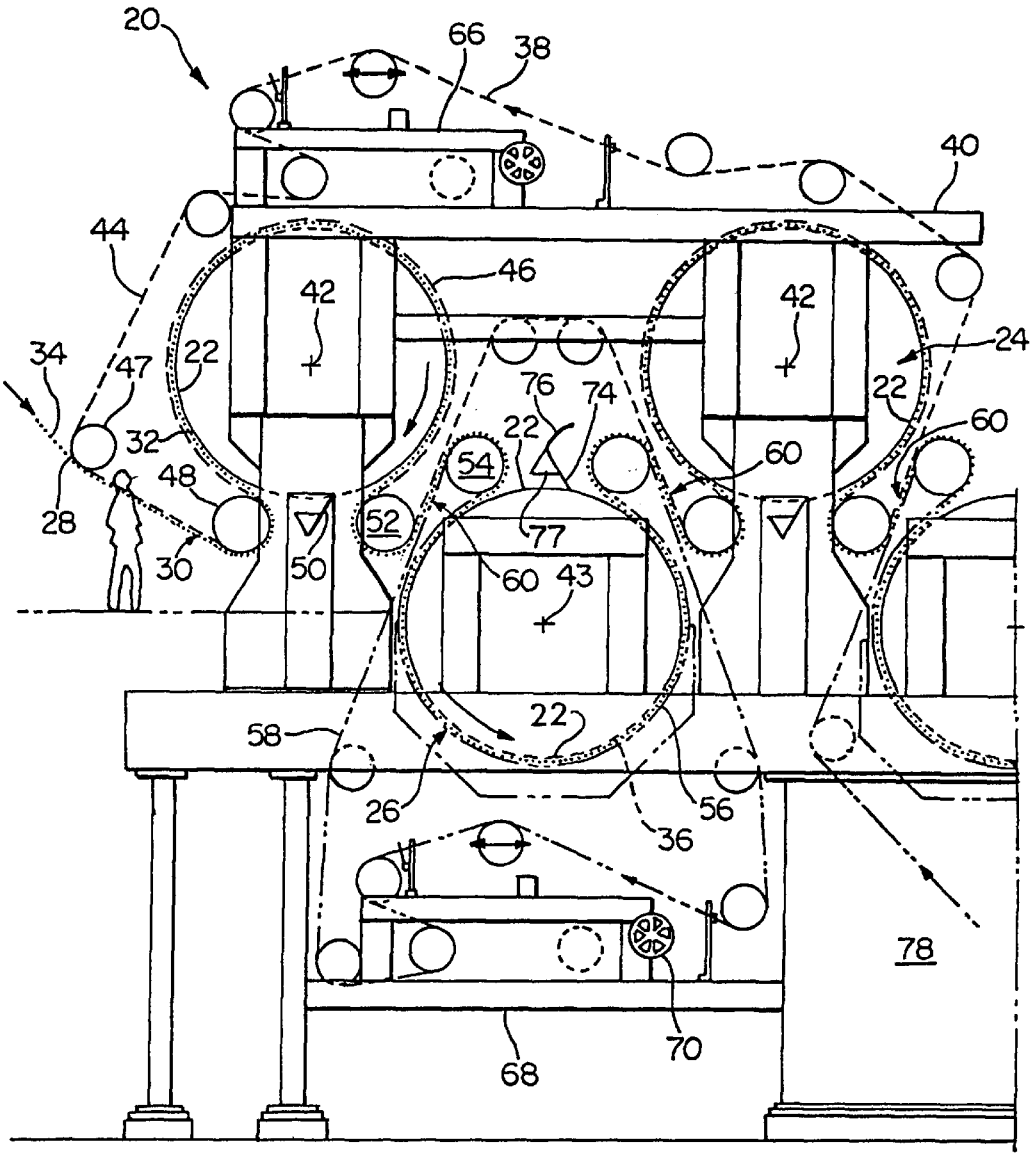
FIG. 1A is a schematic front elevational view of the upstream end of the dryer section of this invention.
Figure 1B:
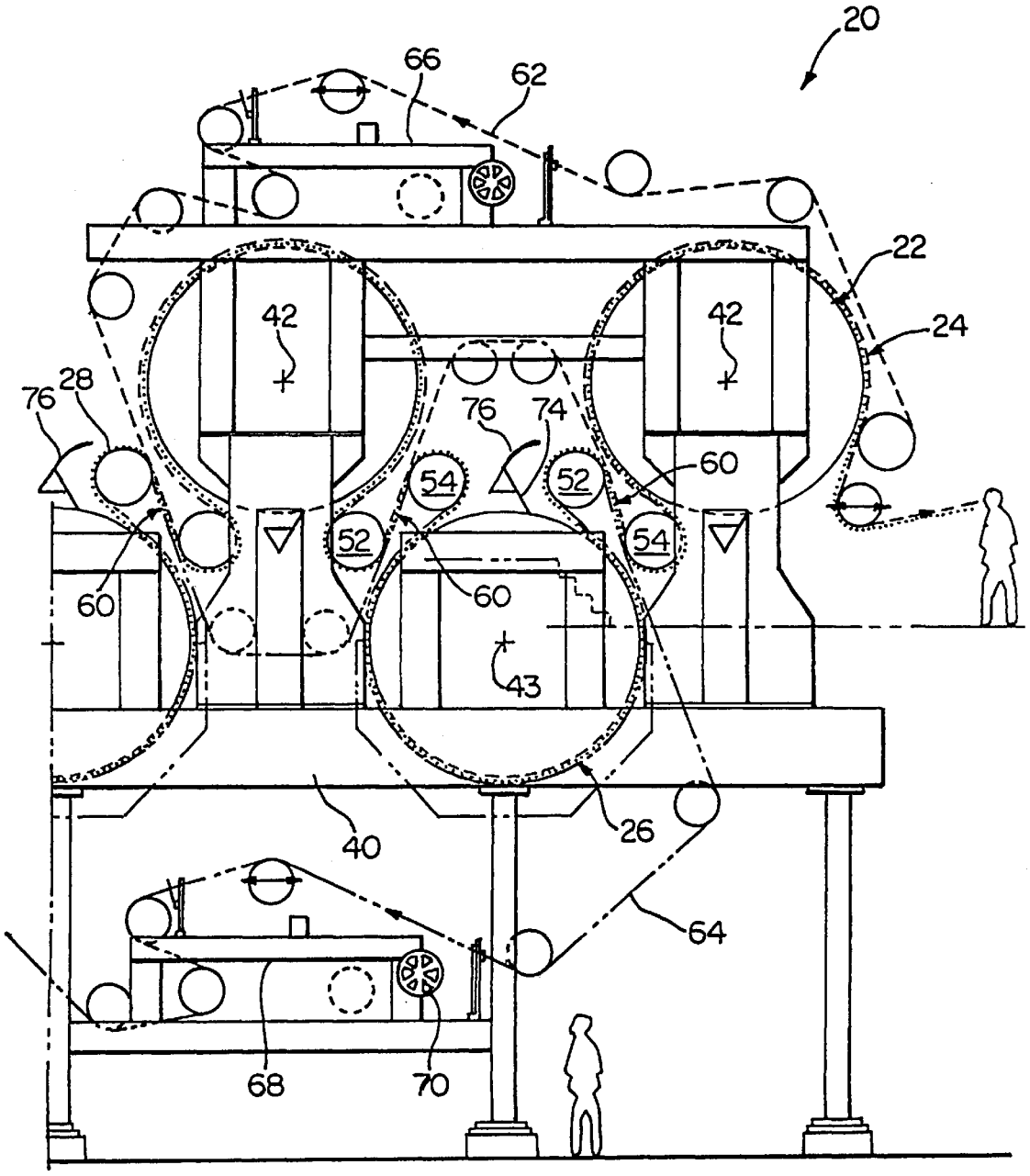
FIG. 1B is a schematic front elevational view of the downstream end on the dryer section of FIG. 1A.

Referring more particularly to FIGS. 1–4 wherein like numbers refer to similar parts, a dryer section 20 is shown in FIGS. 1A and 1B. The dryer section 20 is made up of dryer cylinders 22 arranged in two tiers, an upper tier 24 and a lower tier 26. A paper web 28, indicated schematically by a dotted line, traverses the dryer cylinders 22 in a serpentine path alternating between dryers 22 of the upper tier 24 and dryers 22 of the lower tier 26. The web 28 has a lower side 30 which is brought into engagement with the cylindrical surfaces 32 of the dryers 22 of the upper tier 24. The web 28 has an upper side 34 which is brought into engagement with the cylindrical surfaces 36 of the dryers 22 of the lower tier 26. The web 28 thus is alternately dried on first the lower side 30 followed by the upper side 34. Alternately drying first one side then the other produces a paper which has a low tendency to curl. Curl is an undesirable paper property produced by uneven drying of a paper web. Curl in formed paper can result in paper jamming in many pieces of office equipment where the paper is subjected to heat such as laser printers, copiers and fax machines. For maximum drying efficiency, as much of the dryer surface should be in contact with the web as possible, i.e. more than 180 degrees, and preferably about 270 degrees.

In addition to evenly drying the paper web, the properties of the paper formed are improved if the drying takes place while the web is 5 constrained to prevent the web from shrinking during drying. Shrinkage of the web 28 in the machine direction, which is defined as the direction the paper travels through the papermaking machine, is controlled by the amount of tension the web 28 is subjected to. Tension in the machine direction is adjusted in part by controlling the relative speed at which successive dryers are driven. The paper web 28 is constrained against shrinkage in the cross machine direction by dryer felts 38 and 58 which hold the web 28 against the dryer roll surfaces 32, 36.

Figure 2:
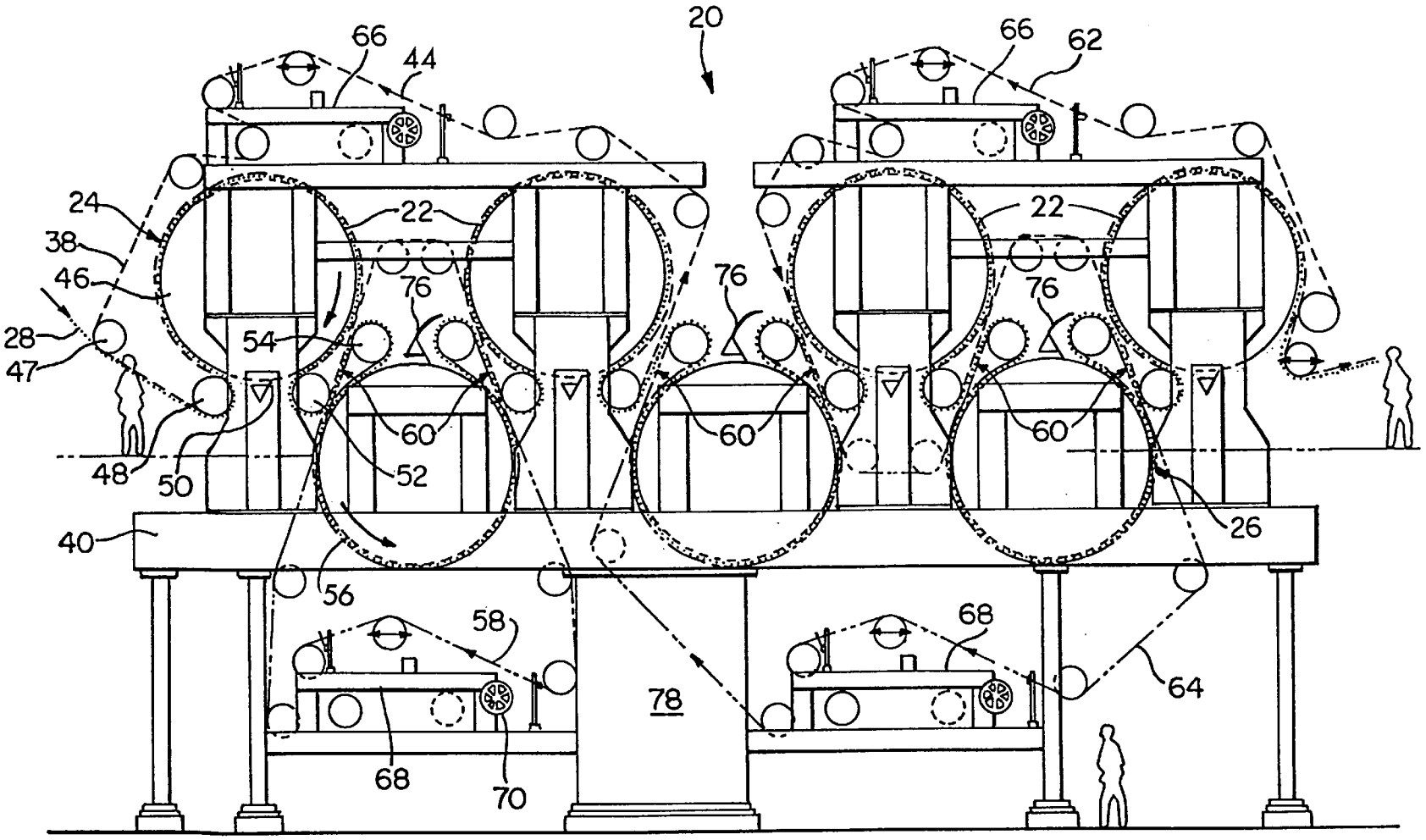
FIG. 2 is a front elevational view of the dryer section of FIG. 1A and FIG. 1B on a reduced scale.

As shown in FIGS. 1A, 1B and 2, the upper tier 24 of dryer cylinders 22 are rotatively mounted to a machine frame 40 about axes 42. The lower tier 26 dryer cylinders 22 are rotatively mounted to the machine frame 40 about axes 43.

The web 28 enters the dryer section 20 from a press section (not shown) and is picked up by a first dryer felt 44. The web 28 is guided into engagement with the first dryer roll 46 by a guide roll 47 which transfers the first felt 44 to a vacuum roll 48 which directs the web onto the surface 32 of the first dryer roll 46. The first dryer roll 46 is twelve feet in diameter and is internally heated with pressurized steam. A doctor blade 50 is positioned beneath the first dryer roll 46 to prevent the web 28 from wrapping around the dryer roll 46 in the event the paper web breaks.

A pair of vacuum rolls 52, 54 or equivalent rolls transfer the web 28 to a lower tier dryer roll 56. A lower tier felt 58 holds the web 28 against the surface 36 of the lower dryer roll 56. The upper felt 44 overlies the web 28 as it is drys in engagement with the upper dryer roll surface 32, but the web is supported on top of the upper felt 44 as the upper felt is turned in engagement with the first vacuum roll 52. The lower dryer felt 58 overlies the web 28 as it wraps around the lower tier dryer roll 56, yet prior to reaching the lower tier dryer roll the lower dryer felt 58 runs beneath the web as it is turned by the second transfer vacuum roll 54. A joint run 60 is formed between the first upper felt 44 and the lower dryer felt 58 where they co-run between the first transfer vacuum roll 52 and the second transfer vacuum roll 54. In the joint run 60, the web 28 is supported between the two felts. For additional background on the use of a joint run in a dryer section see U.S. Pat. Nos. 5,065,529 to Skaugen et al. and 5,269,074 to Sims et al. which are incorporated herein by reference. The joint run 60 prevents the web from fluttering and, because a felt is positioned on either side of the web 28, relatively little drying takes place within the joint run. Thus, where the web 28 is not held by vacuum or felt tension against cross machine direction shrinkage, little shrinkage takes place because very little drying is taking place. Thus the percent of the total time during which the web 28 is constrained while the web is dried is about ninety-six percent. This compares to a typical constraint ratio or percent of between 37 and 85 percent constrained drying using conventional and Bel-Champ dryer systems.

After wrapping around the first lower dryer roll 56, the web proceeds to two vacuum transfer rolls for a second joint run 60 and then to a second upper dryer roll 22. The web progresses through the dryer section 20 alternating between upper and lower dryer rolls. With each transfer from an upper dryer roll to a lower dryer roll, the web switches contact from a top felt to a bottom felt. In the dryer section 20, seven dryer rolls are provided. The total number of dryer rolls selected for a particular dryer section application may be influenced by the amount of drying required and the characteristics of the type of paper being produced and the desired operating speed.

In addition to forming a high quality web without open draws, the dryer section 20 achieves improvements in dryer section length. For a modern paper dryer section, two factors are of chief concern: that the web is held in engagement directly with the surfaces of the dryers, and that there are no open draws. Direct engagement with the surfaces of the dryers speeds heat transfer to the web and thus drying. A dryer section without open draws allows simple and reliable threading and produces greatly reduced susceptibility to deformation and breaking of the paper web. These requirements for a dryer section have led to single tier dryers like the Bel-Champ dryer section available from Beloit Corporation of Beloit Wis. A typical Bel-Champ dryer section achieves about 1.77 inches of dryer surface in contact with the web for each inch of dryer length. The dryer section 20 of this invention has about 2.90 inches of dryer surface in contact with the web for each inch of dryer section length.

A typical Bel-Champ dryer utilizing one vacuum roll between dryers will have one-half as many vacuum rolls per dryer cylinder as the dryer section 20 of this invention. However, because the individual dryer cylinders 22 are twelve feet in diameter--about twice that of a conventional Bel-Champ dryer roll--the number of vacuum rolls 52, 54 for a given amount of drying is about the same. Thus, even though the dryer section 20 has more vacuum rolls per dryer cylinder it is not penalized by the high cost of vacuum rolls because of the proportionately greater drying surface per dryer cylinder.

As best shown in FIG. 2, the dryer section 20 employs two top felts 44, 62 and two bottom felts 58 and 64. Each top felt 44, 62 traverses two dryer cylinders 22. Each top felt has a felt stretcher or tensioner 66 which tensions the felts 44, 62. Because of the larger size of the dryer roll cylinders 22, the felt tension will typically be proportionately higher than the felt on a smaller diameter dryer. For example, if the tension applied to the dryer fabric or felt is between about ten and about twenty pounds per linear inch for a six foot diameter dryer, it may be about twenty to forty pounds per linear inch for a twelve foot diameter dryer roll 22. The bottom felts 58, 64 have felt stretchers 68. The tensioners 66, 68 are adjustable by means of hand wheels 70. In the embodiment shown, the first bottom felt 58 passes around a single dryer roll 56. The second bottom felt 64 passes around two dryer rolls 22 of the lower tier 26. The first top felt 44 wraps two upper dryer rolls, and the second top felt 62 also wraps two dryer rolls. In general each dryer roll 22 can employ a single felt, or two or more dryer rolls may utilize the same felt. The choice of how many dryer rolls to include within one felt run depends on how often it is necessary to change the speed at which the dryer rolls rotate.

Figure 4:
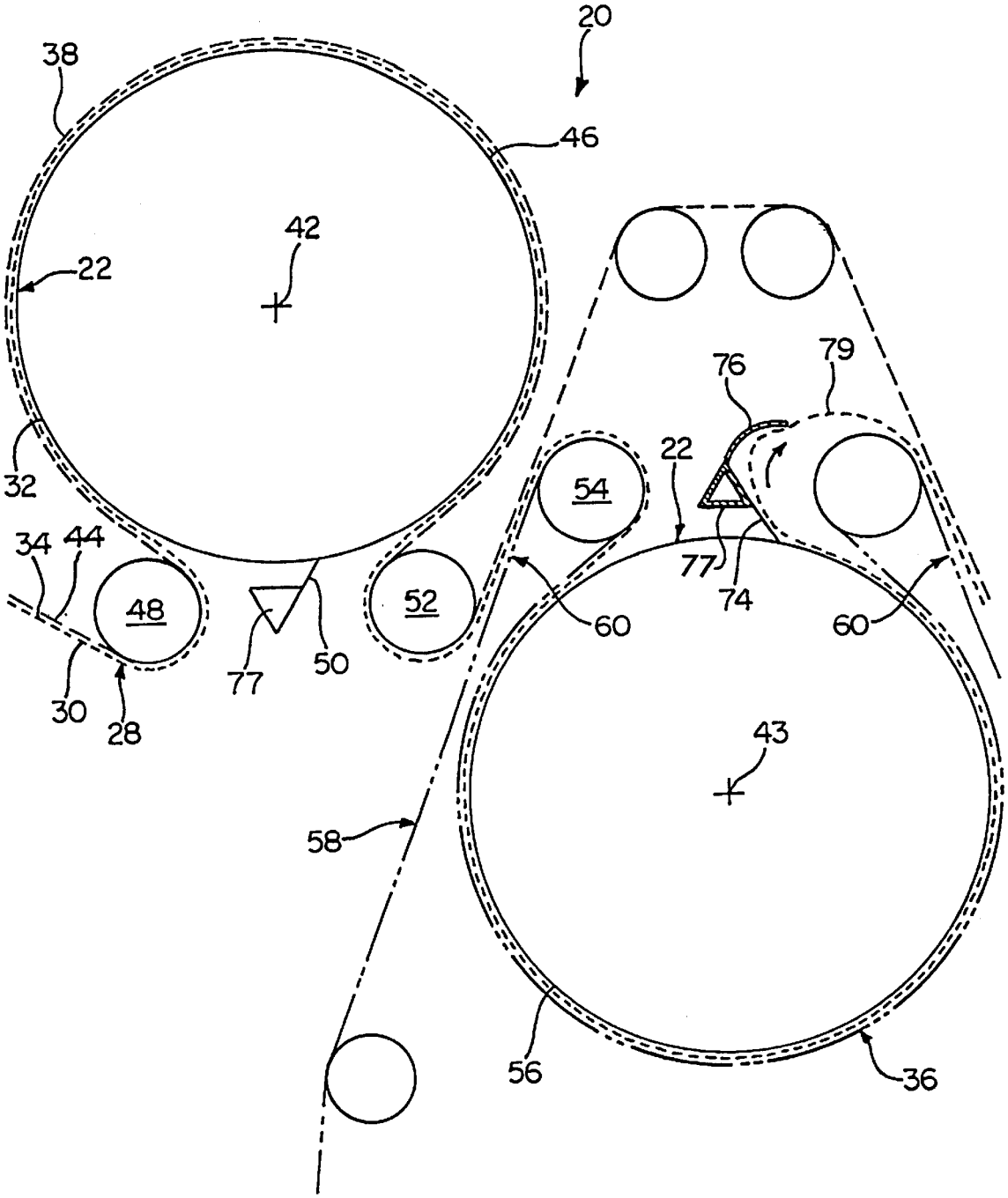
FIG. 4 is an enlarged fragmentary schematic view of a portion of the dryer section of FIG. 1A, functioning to direct broke away from a lower roll.

Single tier top-felted dryers have the advantage that when a paper break occurs, broke is easily removed because the broke, once separated from a dryer, will drop free of the overlying felt. As best shown in FIG. 4, the dryer section 20 overcomes some of the disadvantages of a bottom felted dryer system utilizing the felts themselves to remove broke 79 from the bottom felted dryer rolls. Doctor blades 74 are mounted to doctor backs 77 on the frame 40. The blades 74 are positioned above each lower dryer roll 22 along a portion of roll surface 36 not wrapped by a bottom felt. In the event of a web break, there is a tendency for the severed paper web 28 to wrap around the dryer rolls. The doctor blade 74 engages the lower dryer roll surface 36 and scrapes the waste paper free of the dryer roll. A broke deflecting baffle 76 extends downstream from the doctor blade back 77. The doctored broke engages the downstream-curving baffle 76 and is directed to the nip formed at the downstream joint dryer felt run 60. The rapidly moving top felt and bottom felt grip the broke and drag it through the joint felt run 60, which, because it is unbacked, is sufficiently flexible and expansive to accommodate the rough and possibly wadded broke. The broke is then ejected from the joint run and carried on the bottom felt to the basement area 78, shown in FIG. 1A, where it joins broke recovered from the top felted dryer rolls in the conventional fashion.

Figure 3:
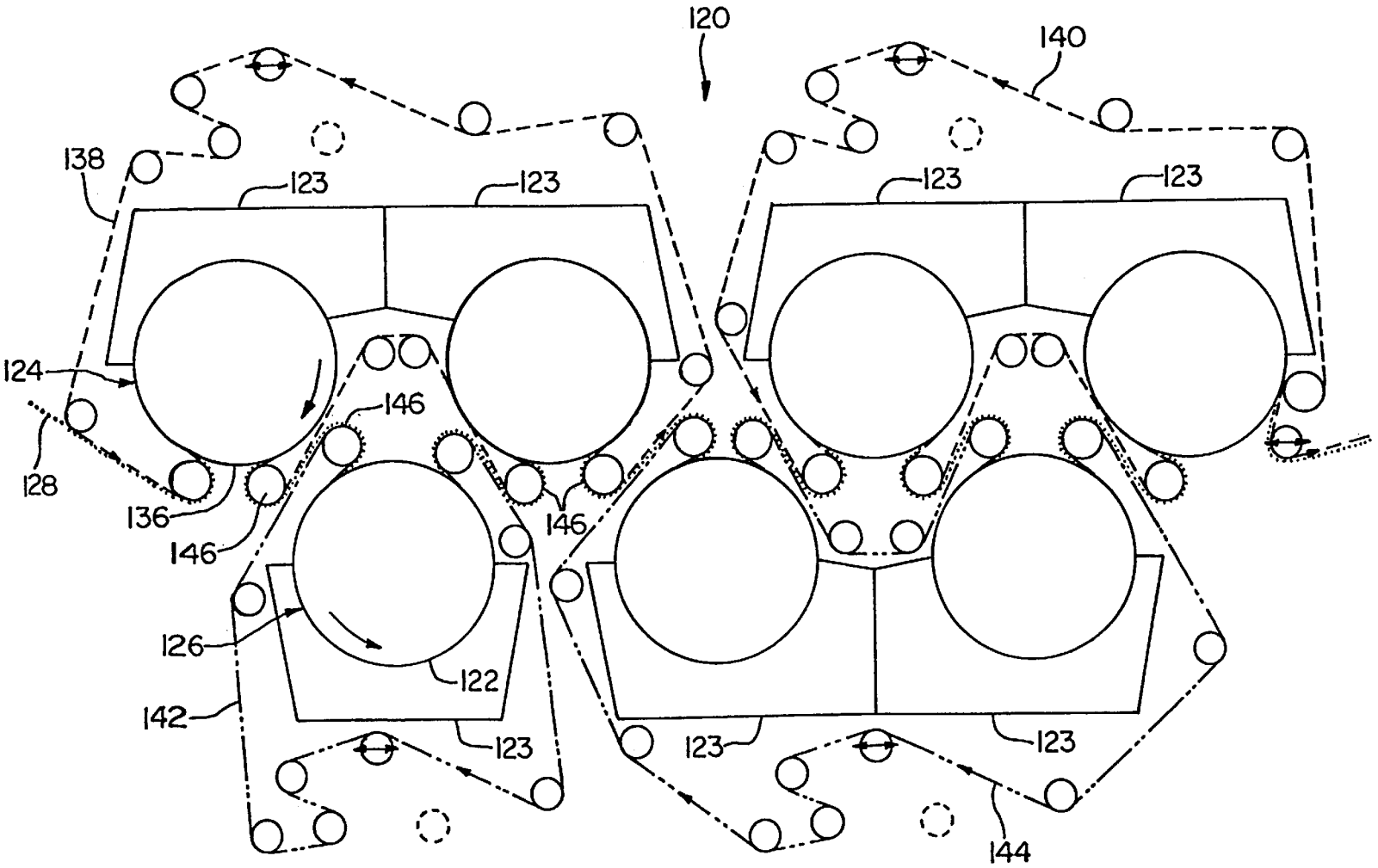
FIG. 3 is a front elevational view of an alternative embodiment of the dryer section of this invention in which air caps are positioned on each dryer cylinder.

An alternative embodiment dryer section 120, shown in FIG. 3, achieves improved performance for each dryer roll 122 by the use of high velocity, high temperatures air impingement hoods 123, such as those manufactured by Beloit Corporation of Beloit, Wis., under the name Air Cap™ dryers. For maximum drying performance, the Air Cap dryers 123 are positioned over the dryer rolls in the upper tier 124 and under the dryer rolls of the lower tier 126. The Air Cap dryers 123 are hoods which overlie portions of the dryer rolls 122 in the upper tier 124 and the lower tier 126 and blow high velocity hot air through the dryer fabrics to dry the affected outer surfaces of the web 128 simultaneously and preferably at the same rate as the roll side of the web is dried by the steam heat transmitted to the surface 136 of the dryer cylinder 122.

In order to allow the passage of air through the felts or dryer fabrics 138, 140, 142, and 144, the dryer fabrics must be of a porous or foraminous nature. Thus, the dryer fabrics employed in the dryer section 120 will have a porosity in the range of four-hundred to twelve-hundred cubic feet per minute per square foot at a pressure differential of one-half inch of water as typically measured by those skilled in the art of the design and construction of papermaking dryer fabrics. The air supplied by the Air Cap dryers 123 may have a temperature range of two-hundred-and-fifty to nine-hundred degrees Fahrenheit and be blown at a velocity of between eight-thousand and forty-thousand feet per minute. These high air temperatures require dryer fabrics which can withstand temperatures of up to nine-hundred degrees Fahrenheit for brief periods of time and steady state temperatures in the range of five-hundred to six-hundred degrees Fahrenheit. The dryer section 120 also employs transfer vacuum rolls 146 as in the dryer section 20. Bottom felted roll doctors and broke-deflecting baffles may also be provided, but have been omitted from the schematic view of FIG. 3 for clarity.

Dryer fabrics of this nature may be constructed of metal, high temperature plastics such as polyetheretherketone (PEEK), or polyphenylene Sulfide (PPS) also sold as Ryton® fibers and manufactured by Phillips Petroleum Company, or other high temperature materials such as Nomex® fiber produced by E. I. Du Pont de Nemours Corporation, 1007 Market St., Wilmington Del., which can be formed into the necessary fibers.

It should be understood that the transfer vacuum rolls 52, 54 may be pivotally mounted to the machine frame 40 to facilitate broke removal. Pivotally mounting the vacuum rolls also allows them to be placed closer to the surfaces 32 of the dryer cylinders 22 which improves runability while allowing the gap between the vacuum rolls 52, 54 and the surfaces 32 of the dryer cylinders 22 to be increased in response to a paper break. A paper break can result in paper wrapping around a dryer cylinder and jamming between a dryer cylinder and a vacuum roll, if the break is not detected sufficiently rapidly or if the vacuum rolls cannot pivot away from the dryer cylinders to provide more space between dryers and vacuum rolls. An example of a pivoting transfer roll is provided in U.S. Pat. No. 4,905,379, the disclosure of which is incorporated by reference herein.

It should be understood that the number of dryers per felt can be varied between one dryer per felt to two or more dryers per felt. In general, a greater number of dryer fabrics has the advantage of reducing the cost and the difficulty in replacing a fabric if one is damaged. On the other hand, fewer dryer fabrics means less square footage of fabric and lower cost. Generally, it is preferred to have more than one cylinder per fabric. However, due to the cost of fabrics and the possibility of fabric damage, it is also desirable to not have any one fabric with excessive length. In any event, upper dryers 24 and lower dryers 26 utilize separate felts. In general, the number of dryer fabrics is equal to the number of times 2 divides evenly into the number of cylinders, plus one if the number of cylinders is odd.

One advantage achieved by the dryer sections 20 and 120 is that the number of dryer or felt roll drive positions required to provide adequate drivability to the dryer sections is less than that which would be required in conventional fabric-driven dryer sections. In the present invention, only one drive cylinder per dryer section would typically be required.

The plane containing the axes 42 of the dryers 22 in the upper row 24 is vertically spaced from the plane containing the axes 43 of the dryers 22 in the lower row 26. The vertical spacing of these planes is preferably spaced approximately equal to the diameter of the dryer cylinders 22 so that there is a small overlapping of the dryers in the direction of the planes defined by the upper and lower dryer axis. This positioning of the dryer cylinders makes it possible to construct a dryer section in which the unwrapped portions of all the dryer cylinders can be disposed at approximately chest height, thus providing convenient operator access to the unwrapped surfaces of the dryers and minimum overall dryer height.

The horizontal spacing of the dryers in one of the rows is preferably less than the diameter of the dryer cylinder 22 so that there is some overlapping of the cylinders in the vertical direction. This provides reduced machine-direction length and increased dryer felt wrap angles.

Although Yankee dryers are built to diameters in excess of twenty-two feet, shipping and manufacturing considerations produce a more practical limitation of ten to fifteen feet in diameter for the dryer cylinders 22.

It should be noted that an upper dryer cylinder is adjacent in the process direction to a lower dryer cylinder, but rolls of the upper plane are never adjacent in the process direction, nor are dryer cylinders in the lower plane adjacent in the process direction.

It is understood that the invention is not limited to the particular construction and arrangement of parts herein illustrated and described, but embraces such modified forms thereof as come within the scope of the following claims.

We claim:

1. A dryer section in a papermaking machine comprising:

a set of dryer cylinders including a plurality of upper dryer cylinders and a plurality of lower dryer cylinders such that upper and lower cylinders alternate, said dryer cylinders being arranged to define a path between cylinders for travel of a web of paper to run from one cylinder to a next cylinder of said set of cylinders so that the paper web is brought into direct contact with each dryer cylinder, wherein a first side of the web is brought into direct contact with the one cylinder and a second side of the web is brought into direct contact with the next cylinder, and wherein the paper web wraps while in direct contact a sector of each dryer cylinder that is larger than 180 degrees;

wherein each upper dryer cylinder is wrapped by an upper dryer fabric which is in direct contact with the paper web while the web is in direct contact with each upper cylinder;

wherein each lower dryer cylinder is wrapped by a lower dryer fabric which is in direct contact with the paper web while the web is directly in contact with each lower dryer cylinder;

the upper dryer cylinders alternating with the lower dryer cylinders;

the web transferring between upper and lower adjacent dryers by a first pair of rolls comprising: a first vacuum roll, and a second vacuum roll, the first vacuum roll being wrapped by the upper dryer fabric, the second vacuum roll being wrapped by the lower dryer fabric, the upper and lower dryer fabrics forming a joint run between the first and second vacuum rolls unbacked by any roll, the first roll being positioned below the second roll, wherein the first and second vacuum rolls are positioned so the web travels upwardly between the first and second vacuum rolls; and the web transferring between lower and upper adjacent dryers by a second pair of rolls comprising a third vacuum roll and a fourth vacuum roll, the third vacuum roll being wrapped by the lower dryer fabric, the fourth vacuum roll being wrapped by the upper dryer fabric, the lower and upper dryer fabrics forming a joint run between the third and fourth vacuum rolls unbacked by any roll, the third vacuum roll being positioned above the fourth vacuum roll so the web travels downwardly between the third and fourth vacuum rolls.

2. The dryer section of claim 1 further comprising at least one air impingement dryer positioned to impinge air toward one of said dryer cylinders of the set of dryer cylinders.

3. The dryer section of claim 2 wherein each dryer cylinder of the set of dryer cylinders has an air impingement dryer positioned to blow air towards said each dryer cylinder.

4. The dryer section of claim 1 wherein the paper web wraps while in direct contact a sector of each dryer cylinder that is about 270 degrees.

5. The dryer section of claim 1 wherein the dryer section has a length in a machine direction and wherein each cylinder has a surface which is traversed by the web as it progresses in the machine direction and wherein the web traverses more then two inches of cylinder surface for each inch of dryer section length over the entire length of the dryer section.

6. The dryer section of claim 5 wherein the web traverses about 2.9 inches of dryer surface for each inch of dryer section length, over the entire length of the dryer section.

7. The dryer section of claim 1 wherein the dryer cylinders have a diameter of about 12 feet.

8. The dryer section of claim 1 wherein the dryer cylinders have a diameter of between ten and fifteen feet.

9. The dryer section of claim 1 wherein each lower dryer cylinder has a top center portion which is not wrapped by the web; and further comprising a doctor blade mounted to engage the top center portion of at least one of said lower dryer cylinders, the doctor blade serving to discharge broke from said lower dryer cylinder.

10. The dryer section of claim 9 further comprising a means for directing broke mounted with respect to the doctor blade to direct broke discharged by the doctor blade into the dryer transferring means to there be conveyed away from the lower dryer cylinder for conveyance to a basement area.

11. The dryer section of claim 1 wherein the number of upper dryer fabrics is equal to the number of times 2 divides evenly into the number of upper dryer cylinders, plus one if the number of upper dryer cylinders is odd.

12. The dryer section of claim 1 wherein the number of lower dryer fabrics is equal to the number of times 2 divides evenly into the number of lower dryer cylinders, plus one if the number of lower dryer cylinders used is odd.

13. The dryer section of claim 1 wherein the upper dryer cylinders have lowermost portions which define a first plane and the lower dryer cylinders have uppermost portions which define a second plane and wherein the second plane is above the first plane such that a vertical distance between the top of the upper dryer cylinders and the bottom of the lower dryer cylinders is less than the combined diameters of the upper and lower cylinders.

14. The dryer section of claim 1 wherein the horizontal spacing of the dryer cylinders at a single tier is less than the diameter of a dryer cylinder.

15. The dryer section of claim wherein the dryer cylinders have a diameter of about 12 feet.

16. The dryer section of claim 14 wherein the number of first dryer fabrics is equal to the number of times 2 divides evenly into the number of upper dryer cylinders, plus one if the number of upper dryer cylinders is odd.

17. The dryer section of claim 14 wherein the number of second dryer fabrics is equal to the number of times 2 divides evenly into the number of lower dryer cylinders, plus one if the number of lower dryer cylinders used is odd.

18. A dryer section extending in a machine direction in a papermaking machine comprising:

a plurality of upper dryer cylinders having upper dryer surfaces, the cylinders arrayed sequentially in the machine direction and having axes of rotation arrayed in substantially a first plane;

a plurality of lower dryer cylinders having lower dryer surfaces, the lower dryer cylinders alternating with the upper dryer cylinders and arrayed sequentially in the machine direction, the lower dryer cylinders having axes of rotation arrayed in substantially a second plane, the second plane being vertically spaced from the first plane;

the upper dryer cylinders alternating with the lower dryer cylinders;

a paper web having a first side and a second side, the web traversing said plurality of upper and lower dryers in a sinuous path, the web defining an upstream direction and a downstream direction as it traverses said plurality of upper and lower dryers, the web engaging each upper and lower dryer surface in turn so that the first side of the web engages each upper dryer cylinder and the second side of the web engages each lower dryer cylinder;

at least a first dryer fabric pressing the web against the upper dryer cylinders when the web first side is engaged with the upper dryer surfaces; and at least a second dryer fabric pressing the web against the lower dryer cylinders when the web second side is engaged with the lower dryer surfaces, wherein the web as it passes from each upper tier dryer to each lower tier dryer, wraps together with the first dryer fabric a first vacuum roll, the web then proceeds downstream to a second vacuum roll spaced from the first vacuum roll, the web wraps the second vacuum roll together with the second dryer fabric, and wherein a joint run of the first and second fabrics between the first and second vacuum rolls is unbacked by any roll, and wherein the web as it passes from each lower tier dryer to each upper tier dryer wraps together with the second dryer fabric a third vacuum roll, the web then proceeds downstream to a fourth vacuum roll spaced from the third vacuum roll, the web wraps the fourth vacuum roll together with the first dryer fabric, and wherein a joint run of the second and first fabrics between the third and fourth vacuum rolls is unbacked by any roll.

19. The dryer section of claim 18 wherein the upper dryer cylinders and the lower dryer cylinders are of about the same diameter and wherein the vertical spacing between the plane containing the axes of the upper dryer cylinders and the plane containing the axes of the lower dryer cylinders is less than the diameter of the dryer cylinders.

20. The dryer section of claim 18 further comprising at least one air impingement dryer positioned over one of the plurality of upper dryer cylinders.

21. The dryer section of claim 18 wherein each upper and lower dryer cylinder has an air impingement dryer positioned to blow air towards each dryer cylinder.

22. The dryer section of claim 18 wherein the paper web wraps while in direct contact a sector of each dryer that is about 270 degrees.

23. The dryer section of claim 18 wherein the dryer section has a length in a machine direction and wherein each cylinder has a surface which is traversed by the web as it progresses in the machine direction and wherein the web contacts more than two inches of cylinder surface for each inch of dryer section length over the entire length of the dryer section.

24. The dryer section of claim 23 wherein the web contacts about 2.9 inches of dryer surface for each inch of dryer section length, over the entire length of the dryer section.

25. The dryer section of claim 18 wherein the dryer cylinders have a diameter of between ten and fifteen feet.

26. The dryer section of claim 18 wherein each lower dryer has a top center portion which is not wrapped by the web; and further comprising a doctor blade mounted to engage the top center portion of at least one of said lower dryer cylinders, the doctor blade serving to discharge broke from said lower dryer cylinder.

27. The dryer section of claim 18 further comprising a means for directing broke into a joint dryer fabric run of the top dryer fabric and the bottom dryer fabric between a first vacuum roll and a second vacuum roll so the doctored broke is directed into the joint dryer fabric run and removed from the vicinity of the lower dryer cylinder.

* * * * *